United States Patent [19]

Levine

[11] Patent Number: 4,794,876

[45] Date of Patent: Jan. 3, 1989

[54] TWO-PIECE COMBINATION BOAT AND LUGGAGE CARRIER

[76] Inventor: Howard E. Levine, 4401 E. Hearn Rd., Phoenix, Ariz. 85032

[21] Appl. No.: 31,229

[22] Filed: Mar. 26, 1987

Related U.S. Application Data

[63] Continuation of Ser. No. 788,684, Oct. 16, 1985, abandoned, which is a continuation-in-part of Ser. No. 660,717, Oct. 15, 1984, abandoned.

[51] Int. Cl.[4] ..... B63B 7/04

[52] U.S. Cl. ..... 114/352; 114/353; 224/328

[58] Field of Search ..... 114/352, 353, 363, 361; 224/309, 327, 328; 292/288

[56] References Cited

U.S. PATENT DOCUMENTS

| | | | |
|---|---|---|---|
| D. 150,087 | 6/1948 | Martin | 224/328 X |
| 842,349 | 1/1907 | Skene | 114/352 |
| 1,280,483 | 10/1918 | Johnson | 114/353 |
| 1,527,089 | 2/1925 | Shipley | 114/353 |
| 2,134,635 | 10/1938 | Le Boeuf | 224/325 |
| 2,157,186 | 5/1939 | Pinter, Sr. et al. | 114/353 X |
| 2,328,693 | 9/1943 | Taylor | 114/77 R |
| 2,584,685 | 2/1952 | Evert | 114/352 |
| 2,659,464 | 11/1953 | Sweetman | 114/353 X |
| 2,714,387 | 8/1955 | Meldrum | 114/361 |
| 2,880,429 | 4/1959 | Henry | 114/363 X |
| 3,000,418 | 9/1961 | Bitting | 224/328 X |
| 3,097,371 | 7/1963 | Rough | 114/353 X |
| 3,153,501 | 10/1964 | Binding | 224/328 X |
| 3,594,834 | 7/1971 | Steensen | 114/353 |
| 3,684,139 | 8/1972 | Johnson | 114/353 X |
| 3,996,635 | 12/1976 | Wilkes et al. | 114/352 |

FOREIGN PATENT DOCUMENTS

| | | | |
|---|---|---|---|
| 1416986 | 10/1975 | United Kingdom | 114/352 |
| 2131866 | 6/1984 | United Kingdom | 292/288 |

*Primary Examiner*—Sherman D. Basinger

*Attorney, Agent, or Firm*—Thomas E. Spath; Lawrence B. Goodwin

[57] ABSTRACT

A two piece combination boat and luggage carrier having essentially identical half-sections and a plurality of removable seats is releasably joined along abutting sides to form a boat. In one embodiment, the halves are pivotally joined by hinges and the bottom of the boat is provided with raised ribs that mate with grooves formed in the bottom of the seats, the top of the seats being adapted to conform to the roof of an automobile, for transporting the luggage carrier. A third central section having inside dimensions greater than the external dimensions of the half-sections is secured between the two half-sections to provide a boat of larger capacity; the third, central section is adapted for nesting over the top of the closed carrier. In another embodiment, each half section is provided with a single male and female member in the abutting end which are adapted to receiving a pair of vertical blades to connect and secure the halves together to form the boat. Outwardly projecting gunnels are adapted to receiving a plurality of removable sliding clamps which secure the two halves together with a continuous gasket providing a water tight seal in the luggage carrier configuration. Each half section is provided with internal storage compartments and flotation, and the projecting gunnels are adapted to receiving fittings for mounting accessories.

32 Claims, 5 Drawing Sheets

TWO-PIECE COMBINATION BOAT AND LUGGAGE CARRIER

This is a continuation of co-pending application Ser. No. 788,684 filed on Oct. 16, 1985 and now abandoned, which is a continuation-in-part of application Ser. No. 660,717 filed Oct. 15, 1984 and now abandoned.

BACKGROUND OF THE INVENTION

This invention relates generally to a combination boat and automobile luggage carrier and a method for its manufacture, and more specifically to a combination boat and automobile luggage carrier in which the seats are adaptable for use as a mounting rack on the automobile roof. The invention further relates to a combination boat and automobile carrier in which the length of the boat can be expanded.

Further, this invention relates generally to a combination boat and luggage carrier and a method for its manufacture, and more particularly to a preferred combination boat and luggage carrier suitable for providing conveniently accessible and easily mounted accessories and parts integral to said carrier.

For the camper, hiker, fisherman, or the like it is often necessary or desirable to transport a boat on the top of an automobile from home to the point of use. Further, it is often desirable on such excursions to have additional storage space for luggage beyond that which is available within the automobile itself. One convenient solution to both of these problems is a combination boat and automobile luggage carrier. Such combinations have existed, and are exemplified, for example, by the combination disclosed in U.S. Pat. No. 3,684,139. The combination boat and luggage carriers that have been available, however, have not been entirely satisfactory. For example, some of the combinations have not been easy to transport on an automobile roof. Often, a considerable amount of the available storage capacity is used up by the need to stow the boat's seats, or by the presence of fixed seats within the storage compartment. Still further, the available boats which fold up to form an automobile luggage carrier have often been too limited in size to accommodate the full party.

Moreover, the available combination boat and luggage carriers are considerably limited in terms of providing variegated uses and accessories when functioning as a boat, as well as a luggage carrier.

A need therefore existed for an improved combination boat and automobile luggage carrier which would overcome the difficulties and shortcomings of the heretofore available models.

It is therefore an object of this invention to provide an improved combination boat and automobile luggage carrier.

It is a further object of this invention to provide a method for fabricating an improved combination boat and automobile luggage carrier.

It is another object of this invention to provide a combination boat and automobile luggage carrier having seats which are adaptable as an automobile rooftop rack.

It is yet another object of this invention to provide an improved combination boat and automobile luggage carrier wherein the seats are used both to lock the boat portions together and to mount the luggage carrier on an automobile roof.

It is a more particular object of the present invention to provide a preferred improved combination boat and luggage carrier suitable for providing variegated uses and conveniently accessible accessories as integral parts of said improved combination boat and luggage carrier including a plurality of storage or cooler compartments with removable storage panels, as well as a plurality of removable seats wherein at least one of said removable seats is capable of being converted into a tackle tray.

It is yet a more particular object of the present invention to provide a preferred improved combination boat and luggage carrier suitable for providing variegated uses embodied in easily and conveniently accessible accessories integral to said carrier including at least one movable seat; a plurality of socket openings, each socket opening suitable for accommodating therein at least one oar and latch combination; at least one motor mount portion and tie down combination; at least one aperture suitable for sturdily accommodating at least one sailmast; a plurality of integral handles therearound said boat and luggage carrier combination capable for accommodating therein a plurality of bracket means for mounting a plurality of canopy leg members in the unfolded boat position and a plurality of clamp members for mounting onto a conventional vehicle rack in the folded luggage carrier position; a plurality of wheel mounting members; and at least one assembly blade member means for removably latching at least two main portions of said boat and luggage carrier combination of the present invention.

BRIEF DESCRIPTION OF THE INVENTION

The foregoing and other objects and advantages of the invention are achieved with a combination boat and automobile luggage carrier as herein described. In one embodiment of the invention the combination includes a forward boat half and an aft boat half, each substantially identical and including a boat bottom and four sides. There is a plurality of seats for the boat, each having a top surface which is contoured to match the contour of an automobile roof for mounting the luggage carrier on the roof. The seats have bottom surfaces which are grooved to engage the outside edges of the boat halves with one seat having the bottom further grooved to engage and lock together the joining sides of the two halves. In further embodiments of the invention the seats are provided with means for accommodating oars, a motor, or sail. Additionally, in one embodiment of the invention a third boat section is used to extend the length of the boat by one third or more.

In another embodiment of a preferred improved combination of boat and luggage carrier of the present invention there is at least one storage or cooler compartment on each of the opposing sides of one of the two half portions, each compartment having a removable panel and a removable seat thereabove which, if desired, may have a plurality of grid-like ribs suitable for being a tackle tray integral to the opposite side of a seating side of said removable seat. In the embodiment of the present invention, immediately described thereabove, at least one movable seat having extending upper sides on at least two opposing sides suitable for removably mounting on an internal ledge-like portion surrounding the boat therethroughout. There is further a plurality of socket openings passing therethrough an outer ledge-like portion surrounding the boat therethroughout for accommodating therein at least one oar and latch combination. Each end opposite the joining side of each half portion has a partial precipice portion for mounting and accommodating therein a motor, if desired. Moreover, there is at least one aperture suitable for sturdily accommodating at least one sail mast and a plurality of integral handles therearound capable of accommodating therein a plurality of bracket means for mounting a plurality of canopy leg members in the unfolded position and a plurality of clamp members for mounting onto a conventional vehicle rack in the folded luggage carrier position. If desired, a plurality of wheel mounting members are integrally joined to the bottom portion of each half portion to accommodate therein at least one wheel in order to provide ease when transporting in either the boat or luggage carrier position. It is preferred that at least one assembly blade member means is provided for removably latching the two main portions of another embodiment of the present invention.

DETAILED DESCRIPTION OF PREFERRED EMBODIMENTS

Figure 1:
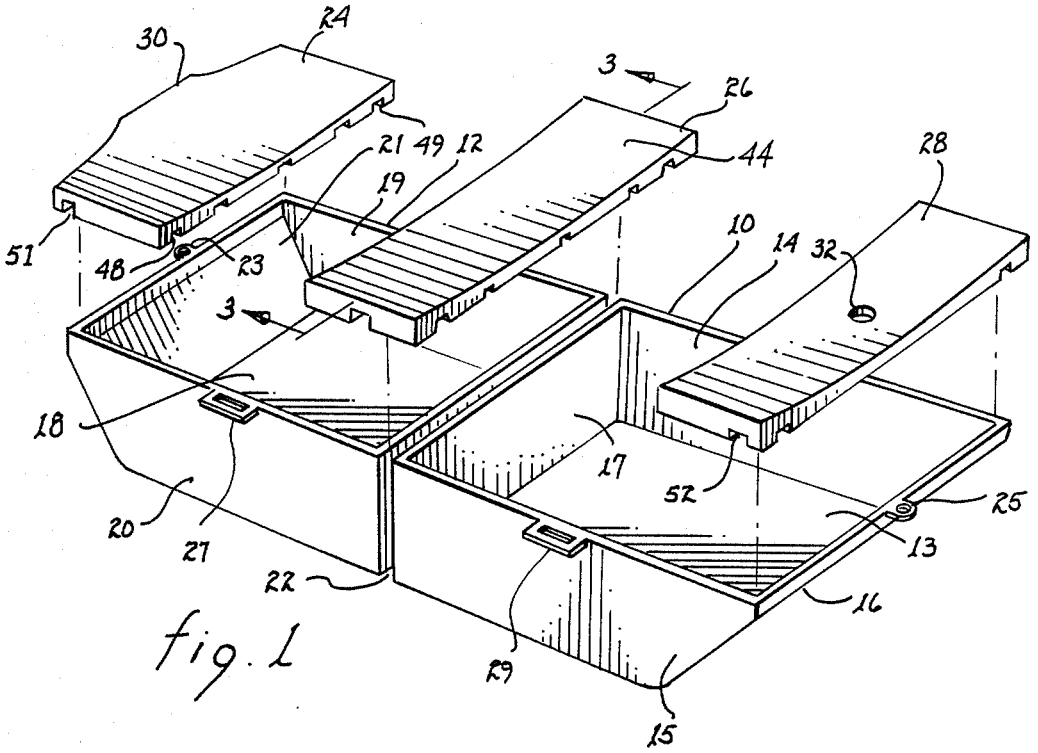
FIG. 1 illustrates a perspective exploded view of an assembled boat in accordance with the invention.

FIG. 1 illustrates in perspective view, the boat's structure in accordance with the invention. The boat structure includes a forward half 10 and an aft half 12 which are substantially identical. The forward half 10 includes a bottom 13 and sides 14, 15, 16, and 17. The aft half 12 includes a bottom 18 and sides 19, 20, 21, and 22. The two halves are joined along a common joining edge formed by the sides 17 and 22. Hinge pieces (not shown) positioned along the top edges of sides 17 and 22 releasably join the two halves together and allow folding of the structure along the joining edge. The forward half 10 has a handle 27 attached to each of its sides 14 and 15. Likewise, the aft half 12 has a handle 27 attached to each of its sides 19 and 20. Note that more than one handle may be attached to each side if desired.

The boat also includes, in this embodiment, three seats 24, 26, and 28 which are shown positioned above their actual designated positions. The seats, which are described in more detail below, fit over and engage with the sides of the two boat halves. Additionally, seat 24 may be provided with a projection 30 to which a small outboard motor may be attached. Seat 28 may be provided with a reinforced opening 32 through which a sail mast may be positioned. Rings 23 and 25 are provided for hanging the halves 10 and 12 when not in use.

Figure 2:
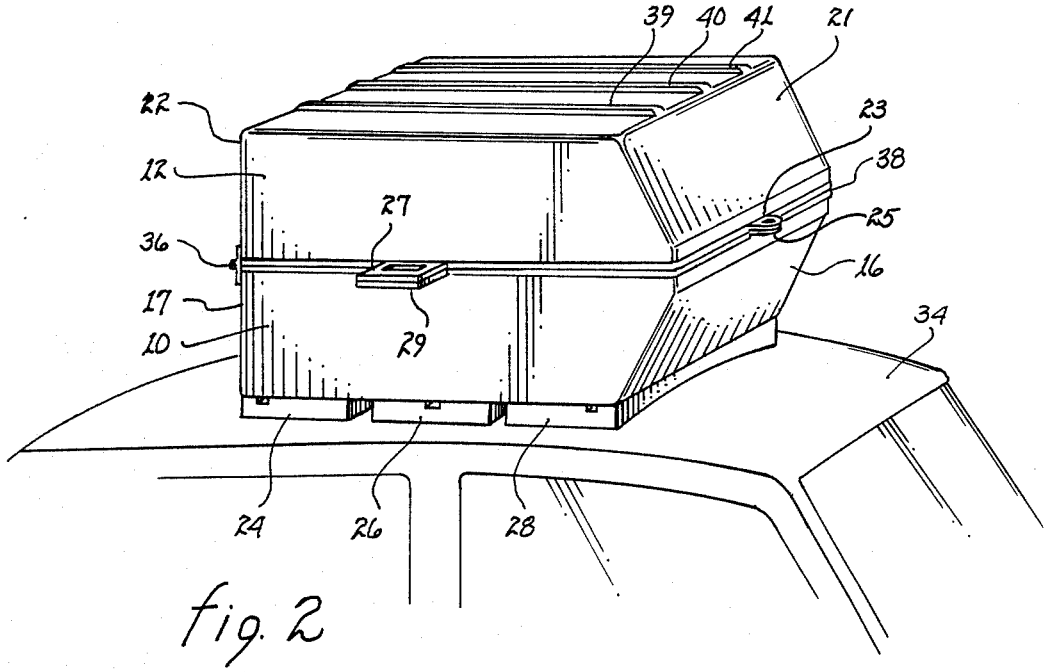
FIG. 2 illustrates in perspective view the structure in accordance with the invention folded into a luggage carrier on an automobile top.

FIG. 2 illustrates the structure, in accordance with the invention, folded into an automobile luggage carrier and mounted on the top of an automobile. The two boat halves 10 and 12 are folded one on top of the other at releasable hinge 36 which is mounted on edges 17 and 22. A flexible gasket surface (not shown) mounted on the top edges of the boat halves provides a snug seal along the joining plane 38. The sides 16 and 21, which otherwise form the bow and stern, respectively, of the assembled boat, are tapered both to ease the passage of the boat through the water and to streamline the luggage carrier. As shown in this view, the two halves of the boat may also be provided with a plurality of ribs, shown here as three ribs 39, 40, and 41 which protrude from the bottoms of the boat and which run along the length of the boat. The ribs stabilize the boat as it moves through the water and also aid in securing the boat to the top of the car as described below. The seats of the boat 24, 26, and 28 are inverted and are used as a mounting rack between the automobile roof 34 and the bottom 13 of the folded luggage carrier. Tie down straps which attach to handles 27 and 29 and/or the luggage carrier or pass over the luggage carrier are attached to the drip rails, door openings or other part of the automobile are not shown in this view, but are of the conventional tie down type.

Figure 3:
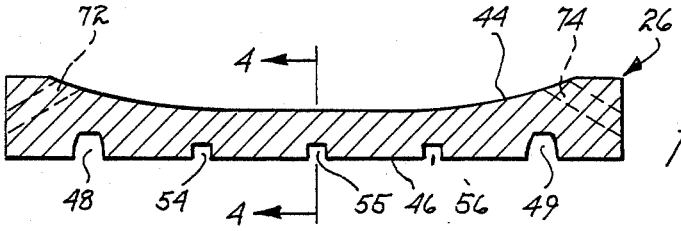
FIGS. 3 and 4 are sections through one of the seats of the boat.
Figure 4:
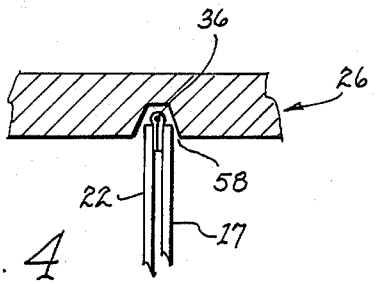

FIGS. 3 and 4 illustrate cross sections through the boat seats as indicated in FIG. 1. The section through seat 26, which is indicated in FIG. 3, illustrates that both the top surface 44 is contoured and that the bottom surface 46 is grooves. Top surface 44 is contoured to fit the shape of an automobile roof 34. With such contour the seat 26 and thus the carrier on top of the seat 26 fits snugly on the automobile roof without sliding and without damaging the finish of the roof. The bottom surface 46 of the seat 26 includes two types of shapes as seen in this view. First, channels 48 and 49 in the underside of the seat 26 are provided to overlap and lock onto the sides of the boat. Preferably, the channels 48 and 49 are tapered so that as they are pushed down onto the boat sides they snugly engage those sides. As seen in FIG. 1, the end seats 24 and 28 have channels 48 and 49 for the sides of the boat and also channels 51 and 52 to accommodate the ends of the boat. The top surfaces of these seats 24 and 28, like seat 26, are also contoured to snugly fit the automobile roof 34. Additionally, the bottom sides of the seats 24, 26 and 28 are provided with channels 54, 55, and 46 which engage with the raised ribs 39, 40 and 41 on the underside of the boat halves. The channels 54, 55 and 56 pass completely through the bottom width of seat 26. However, seats 24 and 28 have channels 54, 55 and 56 which pass only part of the way through their bottom widths in order to prevent the luggage carrier from sliding toward the front or back of the automobile. By engaging the boat ribs 39, 40 and 41 in the seat channels 54, 55 and 56 the luggage carrier is snugly held to the automobile top and motion from side to side or toward the front or back of the automobile is thereby prevented. Note that any number of ribs 39, 40 and 41 and corresponding channels 54, 55 and 56 may be used.

FIG. 4 illustrates a further section through the center of seat 26. This section illustrates a further channel 58 formed in the grooved underside of seat 26, which runs perpendicular to the aforementioned channels in the underside of seat 26. The channel 58, which preferably has tapered edges, fits over and locks together the edges of sides 17 and 22 of the two boat halves. Without some locking mechanism, the two boat halves would be free to rotate about hinge 36; however, as the boat sides 17 and 22 are forced into the channel 58, they are locked in position so that rotation about the hinge 36 is prevented.

Figure 5:
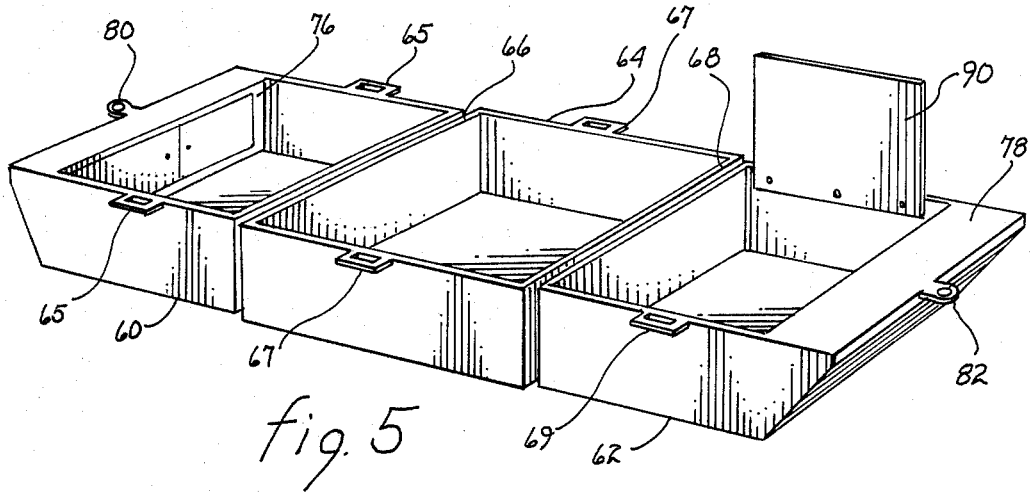
FIG. 5 illustrates in perspective view a further embodiment of the invention.
Figure 6:
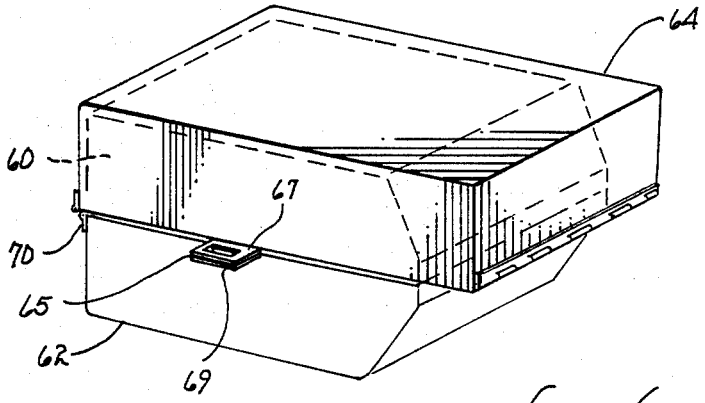
FIG. 6 illustrates the further embodiment of the invention folded into a luggage carrier.

FIGS. 5 and 6 illustrate the further embodiment of the invention which provides a longer boat. This embodiment of the invention is illustrated without seats, but the seats in this embodiment provide the same funtion as that illustrated above. In this embodiment the structure includes two end sections 60 and 62 which are substantially similar to the two boat halves illustrated in FIG. 1. The end sections 60 and 62 have handles 65 and 69, respectively, attached to their sides. In addition, the structure includes a center section 64 with handles 67 which extends the length of the boat. More than one handle may be used at each side of the sections if desired. The combination structure can be used with or without the center section depending upon the length of the boat desired. The center section includes a bottom and four sides and has a length slightly greater than the length of the end sections. The three sections are joined to form a boat by seats which lock the sections together along joining lines 66 and 68.

As illustrated in FIG. 6, the structure can be folded to form an automobile luggage carrier. The two end sections 60 and 62 are releasably joined by releasable hinge pieces 70 which are fastened to their ends. Center section 64, which is slightly larger than either of the end sections is placed either over (as illustrated) or under the two folded end sections for transport on an automobile top. The center section 64, although formally no part of the luggage carrier, is easily transported along with the other sections. As above, the seats are used to mount the luggage carrier on the automobile top. The handles 65, 67 and 69 fit together as shown in FIG. 6 and can be used for strapping the assembly to the automobile roof.

Further embodiments of the invention are illustrated in FIGS. 3 and 5. In FIG. 3, openings 72 and 74 through the center seat section provide oarlocks through which oars can be positioned for rowing the boat. In the embodiment of FIG. 5, similar oarlocks could be provided on both of the seats used to join the three sections, i.e., the seats positioned along joining lines 66 and 68. Additionally, although not shown in the illustration, holes can be provided in the ends of seat 26 into which a conventional oarlock can be positioned.

Figure 7:
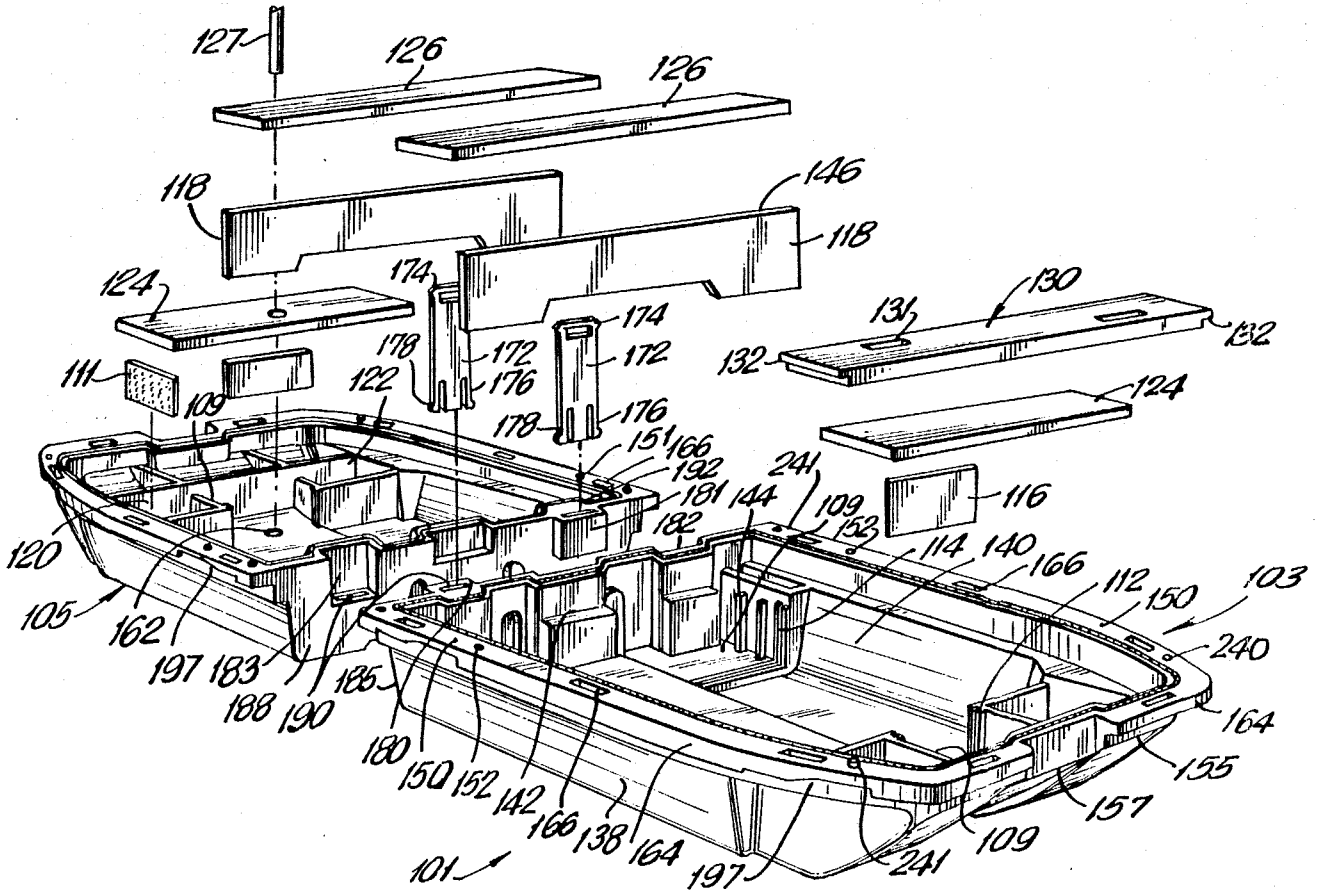
FIG. 7 is an exploded perspective view of a preferred embodiment of an improved combination boat and luggage carrier showing various removable and integral parts suitable for being used, as well as accommodating therein various conveniently accessible accessories when said combination boat and luggage carrier is in use.

In FIG. 7, shown is an exploded view of an improved combination boat and luggage carrier, generally designated by the reference numeral 101, having various removable and integral parts suitable for being used, as well as accommodating therein various conveniently accessible accessories when said boat and luggage carrier combination 101 is in use. Here, a forward half 103 and an aft half 105 which are substantially indentical having storage or cooler compartments 107, 109 having slotted portions 112, 114, respectively, for accommodating therein removable panel members 116, 118. In order to retain desired temperatures for compartments 107, 109 when used as a storage, foam 111 111 may be provided in integral compartments 120, 122 proximate opposite sides of storage or cooler compartments 107 as well as for added bouyancy to meet standard regulations. Thereabove each storage or cooler compartments 107, 109 are removable seats 124, 126 suitable for being mounted thereon. At least one of said removable seats 124, 126 has, opposite a seating side surface therebelow, has a plurality of integral rib-like members extending therefrom suitable for providing a tackle tray, as well as an aperture (not shown) suitable for accommodating a sail mast mounted in recess or aperture 162 (see infra.). A movable or removable seat member 130 has a ledge-type member 132 extending therefrom at least two opposing sides of said seat member 130 as shown in FIG. 1. Each ledge-type member 132 is suitable for being removably mounted onto an external ledge-type member 150 integrally extending therefrom two opposing sides 138, 140 of the forward half 103 and the aft half 105. Moreover, the movable or removable seat member 130 has slotted portions 131 passing therethrough for accommodating assembly blade members 172, as well as having a plurality of rib-like members (not shown) opposite the seating surface for accommodating therein the top surfaces of joining sides 185, 188 when the boat is in use. The removable seat 126 which mounts thereabove the storage or cooler compartment 109 is supported therebelow a support ledge member 142; a plurality of internal rib-like members 144, preferably having a wider upper support member (not shown) for a more stable mounting thereon of said removable seat 126; and the upper side member 146 of the removable panel member 118 for a sturdy, yet removable mounting of said seat 126.

Figure 10:
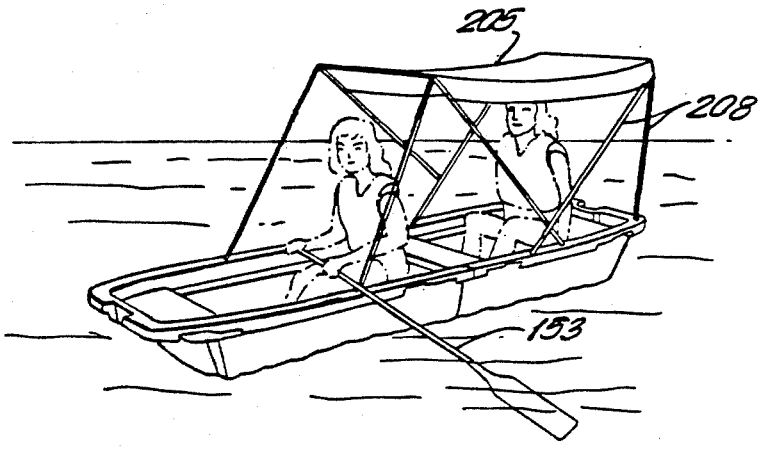
FIG. 10 is a perspective view of the preferred embodiment of the improved combination boat and luggage carrier in its unfolded position used as a boat accommodating therein a canopy and a plurality of operably mounted oars.

Therethroughout the external ledge-type member 150 extending integral therefrom the two opposing sides 138, 140, are socket openings or apertures 152 passing therethrough for accommodating therein a conventional latch member (not shown) for operably mounting therein an oar member 153 (see FIG. 10, infra.). Each of the socket openings or apertures 152 has a matching opposing bottom member 153 for mounting therein in the luggage carrier folded position. At an outward end portion 155 of each of the forward half 103 and the aft half 105 is a combination precipice member 157 extending downward therebetween the external ledge-type member 150 for sturdily mounting and accommodating therein a conventional boat motor (not shown). At the bottom side of at least one of the storage or cooler compartment 107, preferably integral thereto said aft half 105, is a recess or aperture 162 for accommodating therein at least one sail mast (not shown) extending therefrom, if desired.

Morover, therethroughout the external ledge-type member 150 is a plurality of integral handle members 164 configured by a slot portion 166 passing therethrough said external ledge-type member 150. Although not shown, the preferred embodiment of the improved combination boat and luggage carrier 101 may integrally incorporate onto each corner 168, 170 extending therefrom, at least one mounting means (not shown) for operably accommodating therein at least one wheel member (not shown) for ease in transporting either the boat, in the unfolded position, or the luggage carrier, in the folded position. When in the unfolded position, as shown in FIG. 7, at least one assembly blade member means 172 and conventional clamps (not shown) are provided for removably latching the forward half 103 and an aft half 105 together to form the boat assembly. Each of said assembly blade member 172 has a handle portion 174, which can also be a ropelike member, flexible member or the like, thereabove, as well as at least a pair of flexible prong members 176 therebelow.

Each of the prong members 176 is optionally provided wtih outwardly extending foot-type members 178 for locking said assembly blade member 172 when said blades are employed to secure the boat halves together, as explained below. The male member 180 preferably integrally extends from the upper surface of the joining side of one boat half section, and in the opposite joining side of the other boat half is a matching female member 182 which is adapted to accommodate the male member 180. Thus, the joining side of each boat half has a projecting male member and a recessed female member which are positioned to mate with each other when the halves are brought together for assembly. The male members 180, 181 have slotted portions 190, 192 passing therethrough and the female members likewise have a slot for accommodating therein the prong members 176 of the assembly blade member 172. Preferably, the joining side 185 has a pair of male members 180 and a pair of corresponding female members, while the joining side 188 preferably also has a pair of male members 180 and a pair of correspondng female members in a symmetrical fashion, not shown, in order to provide a more stable joint between the joining sides 185, 188 of the forward half 103 and the aft half 105 when in the unfolded position.

Figure 8:
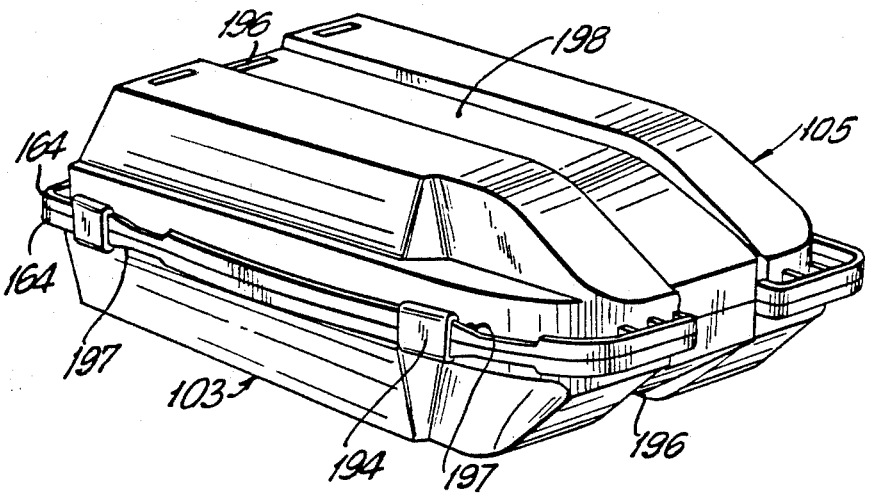
FIG. 8 is a perspective view of the preferred embodiment of the improved combination boat and luggage carrier in its folded position ready for use as a compact and transportable luggage carrier.

When in the folded position, as shown in FIG. 8, both the forward half 103 and the aft half 105 are snugly joined together by a plurality of conventional clamp members 194 removably mounted around the external ledge-type member 150, preferably passing therethrough the slot portions 166. Each of the external ledge-type member 150 therethroughout the forward half 103 and the aft half 105 has a plurality of integral connector members 196 to make sturdy the external ledge-type member 150. At the bottom portion of each forward half 103 and aft half 105 has a streamlined configured surface, as shown in FIG. 8, as well as an indented portion 198 along the entire length of both the forward half 103 and the aft half 105 in order to provide an improved motion through the water surface when the boat is in use.

Figure 9:
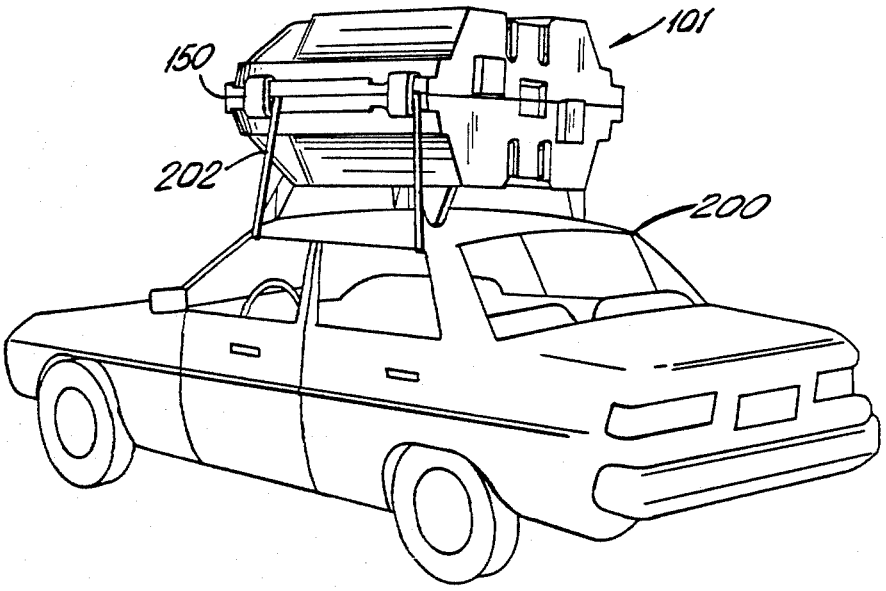
FIG. 9 is a perspective view of the preferred embodiment of the improved combination boat and luggage carrier in its folded position used as a luggage carrier being transported in at least one of a plurality of manners.

As shown in FIG. 9, the combination boat and luggage carrier 101, when transported thereabove an automobile roof 200, has a plurality of conventional strap members 202 suitable for passing therethrough the slot portions 166 (see FIG. 7, supra.) of the external ledge-type member 150.

If desired, a canopy member 205 having a plurality of leg members 208 is provided suitable for being accommodated therein a plurality of bracket means (not shown) for removably mounting therein the slot portions 166 (see FIG. 1, supra.) of the external ledge-type members 150, as illustrated in FIG. 10.

Figure 11:
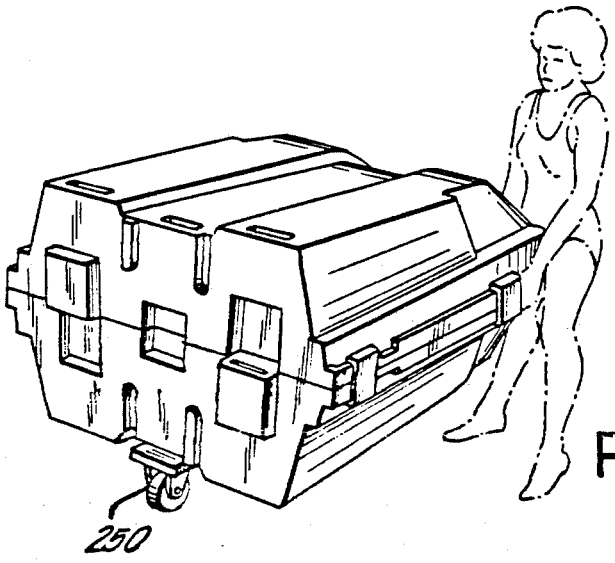
FIG. 11 is a perspective view of the preferred embodiment of the improved combination boat and luggage carrier in its folded position operably accommodating therein at least one wheel assembly for effortless transport thereto a desired location.

If further desired, at least one conventional combination wheel assembly member 250 may be operably coupled to an end portion of the indented portion 198 (see FIG. 8, supra.) proximate each of the joining sides 185, 188, as illustrated in FIG. 11.

The combination boat and luggage carrier, in accordance with the preferred embodiment of the present invention, is preferably fabricated by molding a lightweight yet rigid plastic material to form the above-mentioned sections and plurality of parts. At least one external ledge-type member 150, integral to either the forward half 103 and the aft half 105, has thereabove a waterproof gasket (not shown) to keep the folded luggage carrier waterproof. Alternatively, the above-mentioned boat sections and plurality of parts are formed from sheet metal or like material over a frame or from a plastic foam material covered with fiberglass or the like or any combinations thereof which embody the above-mentioned materials. In any of the construction techniques and methodology, the boat sections are individually watertight. When assembled as a luggage carrier, the storage capacity is at least 27 cubic feet.

In FIG. 5, the end sections 60 and 62 are illustrated with lockers 76 and 78 built into the bow and stern. The lockers can provide for storage of small items and can be provided with a watertight door to provide flotation chambers at either end of the boat. Additionally, rings 80 and 82 can be provided at the bow and stern, to facilitate hanging of the boat halves which can be disconnected along the releasable hinges and then hung on a garage wall.

In a preferred embodiment, a plurality of flexible mats 90 (one of which is illustrated in FIG. 5) are attached to the interior sidewalls of the end boat sections. The mats serve a dual function. During loading of the automobile luggage carrier the mats can be extended upwardly to form a temporary wall around the lower half of the luggage carrier to facilitate the loading of small items into the top half of the carrier. The items would otherwise be loosely stacked above the bottom half of the carrier awaiting enclosure by the top half. As a second function, the mats 90 are preferably provided with a non-skid surface on one side so that in the boat they can be folded down onto the floor of the boat to provide a non-skid and cushioned boat bottom.

The combination boat and automobile luggage carrier, in accordance with the invention, is preferably fabricated by molding a lightweight but rigid plastic material to form the boat sections. The storage compartments 76 and 78 at the ends of the sections are formed of a similar material with waterproof gaskets to keep the sections waterproof. Alternatively, the boat sections are formed from sheet metal or like material over a frame or from a plastic foam material covered with fiberglass or the like. In any of the construction techniques, the boat sections individually are watertight. The bottom ribs can be molded with the boat sections or screwed to the bottom of the already formed sections. The seats are preferably made out of a rigid plastic material with a resilient covering to form a cushioning between the carrier and an automobile roof and to provide comfort as a seat.

Thus it is apparent that there has been provided, in accordance with the invention, an improved combination boat and automobile luggage carrier and a method for its manufacture which fully meet the objects and advantages set forth above. Although the invention has been described with respect to certain illustrative embodiments thereof it is not intended that the invention be limited to these illustrated embodiments. Those skilled in the art will recogize, after consideration of the foregoing detailed description, that variations and modifications differing from these illustrative embodiments are possible. Accordingly, it is intended to include within the invention all such variations and modifications a fall within the spirit and scope of the appended claims.

What is claimed is:

1. A combination boat and automobile luggage carrier which comprises:

a forward boat half and an aft boat half, each having upstanding sides, said two halves releasably hinged together along adjoining upper edges to allow folding along said adjoining edges to enclose a storage volume, or unfolding to form a boat;

a plurality of ribs projecting from and along the length of the bottom of each boat half;

a plurality of seats for said boat, each of said seats having a top surface contoured to adapt to the contour of an automobile roof for mounting said combination on said automobile and a bottom surface grooved to engage the upper edges of the sides of said two halves, and further grooved to engage said projecting ribs when mounted on an automobile roof; and one of said seats further having a bottom surface contoured to engage said adjoining edges and to thereby lock said halves in an unfolded position as a boat.

2. The combination boat and luggage carrier of claim 1 wherein said one of said seats further includes a hole in each end adapted for the passage therethrough of an oar.

3. The combination boat and luggage carrier of claim 1 wherein a second of said plurality of seats further includes a hole adapted for receiving a sail mast.

4. The combination boat and luggage carrier of claim 1 wherein another of said plurality of seats is adapted to fit the aft half of said boat for the attachment thereto of a motor.

5. The combination boat and luggage carrier of claim 1 further comprising storage compartments built into the forward and aft halves of said boat.

6. The combination boat and luggage carrier of claim 1 wherein said two halves are separable along said joining edge for separate storage.

7. The combination boat and luggage carrier of claim 1 wherein one of said seats further comprises a hole adjacent each of the opposite edges, and extending generally downwardly from the upper surface of the seat adapted for holding oar pins and both of said halves includes handles attached to said halves.

8. The combination boat and luggage carrier of claim 1 wherein said forward boat half and said aft boat half comprise substantially identical sections having a bottom and four sides with hinge parts positioned along one of said sides, said one of said sides comprising said joining edge.

9. The improved combination boat and luggage carrier as in claim 1 wherein at least one of said removable seat members has a centrally-located aperture passing therethrough for accommodating therein a sail mast.

10. A combination boat and automobile luggage carrier comprising first, second, and third boat sections, each section comprising a bottom and four sides, said first and third sections being substantially identical, said first and third sections being releasably hinged along a joining edge for folding into an enclosed carrier and capable of being unfolded;

said second section adapted to be releasably joined between said first and third sections to form an extended boat, said second section being further adapted to receive in close fitting relation, said first and third sections when they are folded into an enclosed carrier; and a plurality of seats adapted to mount said carrier on the top of an automobile.

11. The combination boat and automobile luggage carrier of claim 10 wherein two of said seats are adapted for locking said three sections in a boat configuration.

12. The combination boat and automobile luggage carrier of claim 10 wherein said first, second and third boat sections have handles attached to them.

13. The combination boat and automobile luggage carrier of claim 10 wherein said sections are molded from plastic.

14. The combination boat and automobile luggage carrier of claim 10 wherein said sections are formed from sheet metal.

15. A process for fabricating a combination boat and automobile luggage carrier which comprises the steps of:

forming first and second sections including a bottom and four sides;

attaching hinge parts to one side of each of said sections for releasably joining said sections; and forming seats having contoured top and grooved bottom surfaces, said top surface contoured to fit the top of an automobile and said bottom surface grooved to engage the sides of said sections when said sections are joined as a boat, one of said sections further grooved to engage said sections along said one side and to lock said sections in a boat form;

forming raised ribs extending along the length of said bottoms of said sections; and thereafter adapting the grooving of said bottom surface of said seats to engage said raised ribs when said carrier is carried on a vehicle.

16. The process of claim 15 further comprising the step of building storage compartments into each of said sections.

17. The process of claim 15 wherein said step of forming first and second sections comprises molding.

18. In a combination two-section boat and luggage carrier comprising:

first and second substantially identical sections each having a substantially horizontal bottom surface, at least two generally vertical side walls joined to said bottom surface at the periphery thereof, and a generally vertical connecting wall, said connecting wall configured with a male connector which protrudes from the surface of said connecting wall in a direction generally normal to the plane of said connecting wall, and a complementary female connector which is recessed into said connecting wall in a direction generally normal to the plane of said connecting wall, said male and female connectors symmetrically disposed from a vertical center line of the connecting wall, and adapted to mate with each other when the connecting walls of said first and second sections are placed in abutting relation to one another, and a removable connector adapted to join the male and female connectors, the improvement which comprises unitary first and second sections containing integrally molded male and female connectors extending from the upper edge of the connecting walls and terminating at approximately the mid-point of the connecting walls wherein the lower surface of the connecting walls below the male and female connectors is flat, said removable connector is generally planar having flat parallel faces and of a width which is substantially greater than its thickness, and said lower section of the connecting wall is adapted to internally receive said removable connector after its passage through the projecting male connector.

19. The improved combination boat and luggage carrier as in claim 18 further comprising a plurality of compartments containing foam for increasing buoyancy.

20. The improved combination boat and luggage carrier as in claim 18 wherein said combination boat and luggage carrier is made of plastic foam material covered thereover with fiberglass material.

21. The combination two-section boat and luggage carrier of claim 18 wherein said male connector comprises a substantially rectangular member and said female connector comprises a corresponding substantially rectangular recess.

22. The combination two-section boat and luggage carrier of claim 18 further comprising:

a generally vertical slot through said male connector and a generally vertical slot through said connecting wall vertically adjacent to and aligned with said female recess, such that when said male and female connectors are positioned in abutting, mated relationship, said slots create a vertical passageway, and wherein said removable connector comprises an assembly blade adapted to be inserted into said vertical passageway and to lock said connecting walls together.

23. The combination two-section boat and luggage carrier of claim 22 wherein said assembly blade comprises a generally planar, rectilinear structure having a handle, and a resilient prong on at least one side thereof to facilitate the insertion into, and removal from, said vertical passageway.

24. The assembly blade of claim 23 wherein said prong is configured with an angled protrusion at the bottom thereof adapted to retain said assembly blade in place when inserted into the passageway.

25. The combination two-section boat and luggage carrier of claim 23 further comprising a center seat adapted to engage and secure the upper edges of said connecting walls, when said connecting walls are joined.

26. The combination two-section boat and luggage carrier of claim 25 wherein said center seat is provided with slots aligned with the slots through the male connectors and adapted to receive said handles on said assembly blades when said assembly blades are inserted into the male connectors, and wherein the tops of said handles are substantially flush with the top of said center seat when said center seat is in place over the connecting walls.

27. The combination two-section boat and luggage carrier of claim 18 further comprising a resilient elastomeric gasket attached to the upper surface of the periphery of the first section and adapted to mate with the upper surface of the periphery of the second section when said second section is placed on top of said first section, to prevent water from entering the structure when the structure is configured as a carrier.

28. The two-section boat of claim 18, further comprising a plurality of slots disposed along the upper edges of at least one of said vertical sidewalls to facilitate the connection of an implement to the boat.

29. A combination two-section boat and luggage carrier of claim 18 wherein said generally vertical sidewalls terminate in outwardly extending, downwardly projecting flange surfaces adapted to receive a plurality of clamps to secure the superposed first and second sections.

30. The combination structure of claim 29 wherein the downwardly projecting flange surface is contoured to receive the clamps.

31. The combination structure of claim 30 wherein the clamps are generally C-shaped and slidingly engage the flanged surfaces of the superposed sections.

32. A two-section boat comprising, first and second sections of molded structural foam each having a substantially horizontal bottom surface, at least two generally vertical side walls joined to said bottom surface at the periphery thereof, and a generally vertical connecting wall, said connecting wall on said first section configured with an integrally molded male connector which protrudes from the surface of said connecting wall in a direction generally normal to the plane of said connecting wall, said connecting wall on said second section having a complementary integrally molded female connector which is recessed into said connecting wall in a direction generally normal to the plane of said connecting wall, whereby said male and female connectors mate with each other when the connecting walls of said first and second sections are placed in abutting relation to one another, and wherein the male and female connectors extend from the upper edge of the connecting wall and terminate at approximately the midpoint of the connecting wall, and the lower surface of the connecting wall below the male and female connectors is flat, at least one generally vertical slot through said male connector and at least one generally vertical slot through said connecting wall vertically adjacent to and below said female recess such that when said male and female connectors are in abutting, mated relation, said slots create a vertical passageway, and a generally planar assembly blade having flat parallel faces and a width which is substantially greater than its thickness for insertion into said passageway and adapted to lock said connecting walls together.

* * * * *